United States Patent [19]

Iten

[11] Patent Number: 4,977,670

[45] Date of Patent: Dec. 18, 1990

[54] SHAVING IMPLEMENT

[75] Inventor: Clemens A. Iten, Fisherville, Va.

[73] Assignee: American Safety Razor Company, Verona, Va.

[21] Appl. No.: 451,590

[22] Filed: Dec. 18, 1989

[51] Int. Cl.[5] ..... B26B 21/00

[52] U.S. Cl. ..... 30/49; 30/50; 30/346.55

[58] Field of Search ..... 30/42–50, 30/346.5, 346.55

[56] References Cited

U.S. PATENT DOCUMENTS

| | | |
|---|---|---|
| 1,011,844 | 12/1911 | Posthans . |
| 1,035,308 | 8/1912 | Boulter . |
| 1,159,647 | 11/1915 | Bruecker . |
| 1,382,301 | 6/1921 | McCaffrey . |
| 1,501,450 | 7/1924 | Hasselquist . |
| 1,598,189 | 8/1926 | Addison . |
| 1,958,718 | 5/1934 | Schermack . |
| 2,359,584 | 10/1944 | Roehner . |
| 3,127,676 | 4/1964 | Johnson . |
| 3,412,464 | 11/1968 | Keck . |
| 3,777,396 | 12/1973 | Simonetti . |
| 4,336,651 | 6/1982 | Caro . |
| 4,807,360 | 2/1989 | Cerier . |
| 4,875,288 | 10/1989 | Trotta et al. ..... 30/50 |

*Primary Examiner*—Douglas D. Watts

*Attorney, Agent, or Firm*—Nixon & Vanderhye

[57] ABSTRACT

The shaving implement comprises a housing having a plurality of apertures through a shaving surface, each aperture containing a razor assemblage. Each assemblage includes a soap bar guard and a razor blade connected to one another and mounted for angular and linear floating movement in the housing on a resilient pad. The soap bar guard extends beyond the periphery of the cutting edge of the blade and defines an annular opening for receiving debris from the shaving action. The razor blade is circular and may be flat, dished or concave or have an annular planar margin with a cup-shaped depression so that the connection between the blade and guard lies below the plane containing the razor edge.

19 Claims, 1 Drawing Sheet

FIG. 1
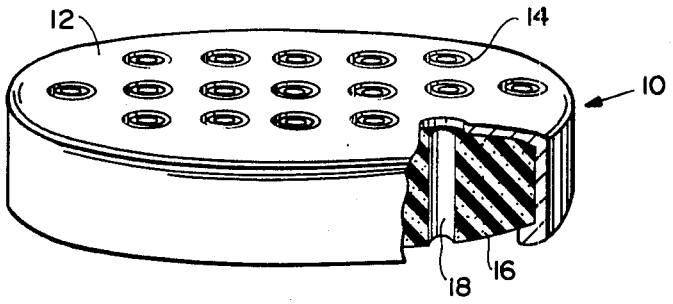
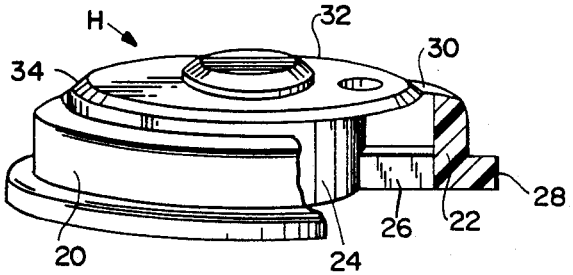
FIG. 2
FIG. 3
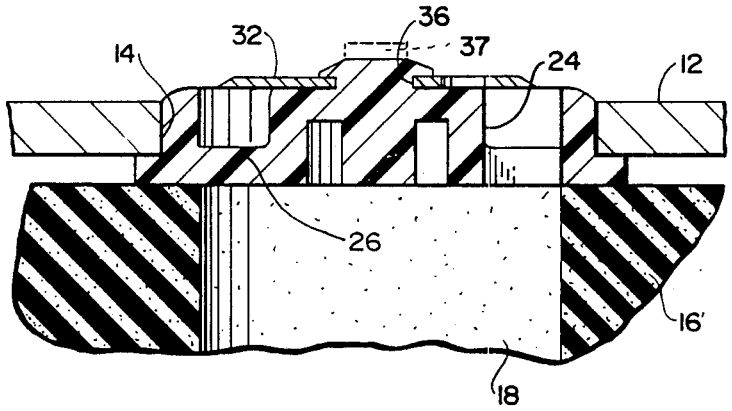
FIG. 4
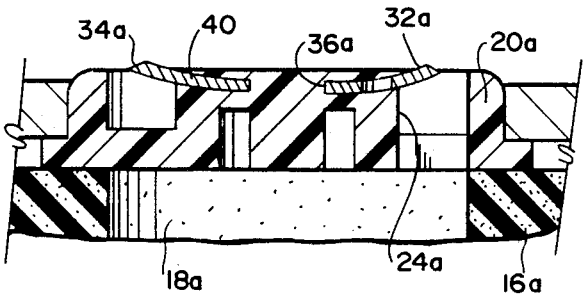
FIG. 5
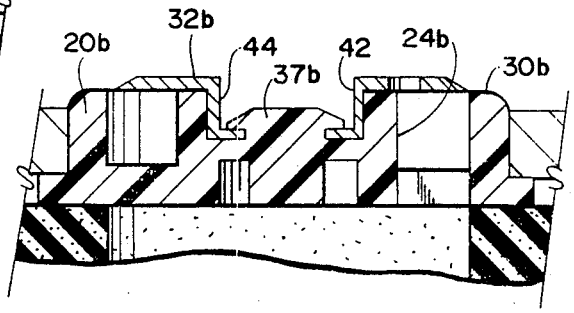

SHAVING IMPLEMENT

BACKGROUND AND SUMMARY OF THE INVENTION

The present invention relates to a shaving implement of the type having a plurality of shaving heads carried by a single housing and is particularly useful for shaving delicate areas, such as the legs or underarms. More particularly, the present invention relates to a shaving implement having multiple shaving heads wherein each shaving head includes a razor blade and a soap bar guard cooperable to provide smooth, comfortable, efficient and safe removal of hair.

Various types of shaving devices, particularly having a multi-shaving-head configuration, have been proposed or constructed in the past. Many of these devices, however, do not efficiently perform their intended function. For example, certain devices do not readily conform to the contours of the skin surface being shaved. This can lead to skin discomfort as well as an ineffective shave. In other devices of this type, the blades are arranged in a manner which may possibly nick or cut the individual using the shaving implement.

According to the present invention, the problems identified above and endemic to shaving implements of the multiple head type are minimized o eliminated.

Preferably, and in accordance with the present invention, there is provided a shaving implement having a multiplicity of shaving heads spaced one from the other and disposed about the shaving surface of the implement. The shaving surface has a plurality of apertures for receiving the heads. Each shaving head includes a razor assemblage comprising a razor blade and a soap bar guard. Each razor. assemblage, when located in its aperture, is also capable of linear and angular movement relative to the shaving surface of the implement which, in combination with each, facilitates safe, efficient shaving of delicate areas.

To accomplish the foregoing, there is provided a resilient sponge-like material underlying the shaving surface and apertures. Each razor assemblage is disposed and retained in a corresponding aperture and rests on the resilient material. The guard for the razor assemblage preferably has an outwardly directed flange which engages below the margin of the housing about the aperture to secure the assemblage in the implement and in bearing engagement with the resilient material. Preferably, the guard is comprised of an annular member having a central hub and a plurality of ribs extending from the hub outwardly and connecting with the annular member. The guard mounts on its exposed side, i.e., the side thereof remote from its underside and which bears against the resilient material, a razor blade having an outwardly directed peripheral cutting edge. The margin includes an upstanding portion which is spaced from the razor blade edge to define a soap bar guard therewith. There are also provided at least one through opening in the guard and openings in the resilient material underlying the guard into which shaving debris collected between the razor edge and the guard may flow.

In a preferred embodiment of the present invention, the razor blade of the razor assemblage is flat and annular in shape overlying the larger diameter guard. The blade has a central opening which receives a pin projecting axially from the hub and which pin is deformed on the outer surface of the razor blade to secure the blade and the guard one to the other. In another embodiment hereof, the razor blade may be concave in shape. The central opening receiving the pin and the deformed head of the pin may therefore be disposed below a plane containing the razor blade edge. In this manner, interference with the shaving action by the connecting element between the razor blade and the guard, e.g., the pin, is avoided. In a still further form of the present invention, the razor blade may have a generally cupped shaped depression adjacent a central portion thereof. In this form, the pin head may likewise be recessed below the plane of the razor blade edge.

With the foregoing described constructions, and particularly the floating heads and the cooperation of the soap bar guard and razor blade edge, there is provided a safe, efficient cutting mechanism which may follow the various contours of the surface being shaved and provide a close shave.

According to one aspect of the present invention, there is provided a housing having a surface with a plurality of apertures therethrough. A body formed of resilient material is disposed within the housing. A razor assemblage is carried by the housing for disposition in each of the apertures and includes in each assemblage a guard and a blade. Each guard has an outwardly directed flange about its periphery and upper and lower surfaces. There are means cooperable between the flange and the housing for retaining each guard in a corresponding aperture through the body surface with the lower surface of each guard engaging the resilient material. The razor blade has a cutting edge about its periphery and means for securing the guard and the blade to one another.

According to another aspect of the present invention, there is provided a housing including a surface with a plurality of apertures therethrough. A razor assemblage is carried by the housing for disposition in each of the apertures and in each assemblage there is a guard and a blade. Each guard has upper and lower surfaces with means cooperable between the guard and the housing for retaining each guard in a corresponding aperture through the body surface. The razor blade has a cutting edge about its periphery and faces outwardly of the blade with means for securing the guard and the blade to one another. The guard has a periphery spaced outwardly of the periphery of the cutting edge of the blade and substantially equidistantly therefrom.

Accordingly, it is a primary object of the present invention to provide a novel and improved shaving implement of the type having a multiplicity of floating shaving heads for the safe and efficient shaving of delicate areas and in a manner wherein the floating heads may effectively follow the contours of the surface being shaved.

These and further objects and advantages of the present invention will become more apparent upon reference to the following specification, appended claims and drawings.

BRIEF DESCRIPTION OF THE DRAWING FIGURES

FIG. 1 is a perspective view of the shaving head portion of a shaving implement constructed in accordance with the present invention and illustrated with parts broken out and in cross-section;

FIG. 2 is a perspective view of an individual shaving head constructed in accordance with the present invention with parts broken out and in cross-section for clarity;

FIG. 3 is an enlarged cross-sectional view of a shaving head hereof mounted in the shaving implement; and FIGS. 4 and 5 are views similar to FIG. 3 illustrating second and third embodiments of the shaving head hereof.

DETAILED DESCRIPTION OF THE DRAWING FIGURES

Reference will now be made in detail to the present preferred embodiment of the invention, an example of which is illustrated in the accompanying drawings.

Referring now to the drawings, particularly to FIG. 1, there is illustrated a shaving implement, generally designated 10. Implement 10 includes a housing 12 which, in plan view, is in the general shape of an oval. The housing is formed of an elastomeric or plastics material, affording substantial rigidity to it, yet has some flexibility for purposes of improved comfort, as will become clear. Housing 12 has a plurality of openings 14 spaced one from the other through its upper surface, i.e., the surface to be engaged with or in opposition to the skin surface to be shaved. The openings 14 are arranged either symmetrically or non-symmetrically in the body 10 as desired, there being five transversely extending rows of three openings each, with one central opening at opposite ends of the shaving implement of the illustrated form hereof. Each opening 14 houses a shaving head, generally indicated H in FIG. 2. Within the shaver housing 12, there is provided a body or pad 16 of resilient material which is of a highly flexible and absorbent nature. The resilient body 16 has a plurality of openings 18 extending therethrough in substantial alignment with the openings 14 in the housing 12 for purposes which will become clear from the ensuing description.

Referring now to FIG. 2, each shaving head H includes a soap bar guard 20 in the form of an annulus 22 spaced from and surrounding an interior hub 24. The outer annulus 22 and interior hub 24 are connected one to the other by a plurality of circumferentially spaced radially extending connecting elements or spokes 26. The outer annulus 22 also includes an outwardly projecting generally circular flange 28 extending radially outwardly from the lower side of the annulus. When the shaving head is secured in the shaver housing 12, the flange 28 engages below or along the undersurface of the housing 12 surrounding each opening 14 to retain the shaving head H in the shaving implement. As illustrated in FIG. 3, the underside of annulus 22 rests on and bears against the flexible sponge-like body 16. The soap bar guard 20 is preferably formed of an integrally molded plastics material and has a smooth contoured upper surface which forms a smooth transition surface 30 between the vertical sides of the guard 20 and the cutting edge of a razor blade 32.

The razor blade 32 comprises a disk or an annular member having an outwardly directed, circumferential edge honed to provide a cutting edge 34 for the blade 32. The blade 32 has a central aperture 36 (FIG. 3). Aperture 36, in assembling the blade onto the soap bar guard 20, receives the upwardly projecting pin 37, shown in dashed lines in FIG. 3, which may then be staked over the upper surface of the blade 32 to secure the blade 32 and the soap bar guard 21 one to the other. One or more openings 38 is formed in the blade 32 at a location between the central opening 36 and the blade edge 34 to facilitate handling during manufacture and assembly. Also, the blade edge 34 extends radially, as illustrated in FIG. 3, short of the transition surface 30 of the guard to define an annular opening therebetween in communication with the space between the hub 24 and annulus 22.

With reference to FIG. 3, it will be appreciated that in assembling the shaving head 16 onto the body 12, the flange 28 is disposed between the margin along the undersurface of housing 12 about opening 14 and the upper surface of the resilient body 16. In this fashion, each head H floats on the resilient surface of element 16 and both axial and angular movement of the head is permitted. Also note that the openings between the hub 24 and the annulus 22 of the soap bar guard 20 and circumferentially between the spokes 26 thereof open into the apertures 18 formed through the body 16. Thus, shaving debris may flow through the annular opening between the cutting edge 34 and the transition surface 30 of the soap bar guard 20 into the spaces between the hub and the annulus for flow into the apertures 18.

Referring now to FIG. 4, there is illustrated a second embodiment of shaving head hereof. In this embodiment, like reference numerals are applied to like parts as in the previous embodiment, followed by the letter "a" as a suffix thereto. In this form, the upper surface of the soap bar guard **20*a* in the area of the hub 24*a* is dished or recessed to form a concavity 40. An annular blade 32*a* having a similar dished or concaved configuration lies in conformal relation to the upper surface of hub 24*a*. As in the previous embodiment, the pin extends through the central opening 36*a* in the blade 32*a* and is staked about the margin of the opening 36*a* to secure the blade 32*a* and the soap bar guard 20*a* one to the other. Note that the elevation of the staked pin lies no higher than the elevation of the razor blade edge 34*a***. In this manner, the stake for securing the blade to the soap bar guard does not protrude above the blade edge and thus does not interfere with the shaving procedure.

Referring now to FIG. 5, there is illustrated a still further embodiment of the present invention and like reference numerals are applied to the features thereof as in the first embodiment, succeeded by the letter "b" as a suffix thereto. In this embodiment, the soap bar guard **20*b* has a hub 4 which is generally cylindrically recessed at 42 along its upper surface. The blade 32*b* has a similar cylindrical portion 44 disposed in conformal relation in the recess 42 of the hub 24*b*. The pin 37*b* of the soap bar guard 20*b* extends upwardly through a central opening 36*b* in the recessed cylindrical portion and the staking operation is effected within the cylindrical portion 42. The blade therefore resides at an elevation generally corresponding to the elevation of the transition surface 30*b*** of the soap bar guard. As in the previous embodiment, the staking operation thus is recessed from the surface of the blade and does not afford any interference while shaving.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A shaving implement, comprising:

a housing having a surface with a plurality of apertures therethrough and a marginal portion of said housing about each said aperture;

a body formed of resilient material disposed within said housing;

a razor assemblage carried by said housing for disposition in each of said apertures and including in each assemblage a guard and a blade;

each said guard having an outwardly directed flange about its periphery and upper and lower surfaces;

means including said flange and said marginal portion for retaining each said guard in a corresponding aperture of said housing with a lower surface of said guard engaging said resilient material;

said razor blade having a cutting edge about its periphery; and means for securing said guard and said blade one to the other.

2. An implement according to claim 1 wherein said razor blade is flat and lies in a single plane.

3. An implement according to claim 1 wherein said razor blade is concave facing the side of said razor assemblage remote from said guard.

4. An implement according to claim 1 wherein said blade has a flat peripheral margin including said edge and a generally cup-shaped central portion depressed from a plane containing said peripheral margin for engagement with said guard.

5. An implement according to claim 1 wherein said blade has a central opening, said securing means extending through said central opening for securing said blade and said guard one to the other.

6. An implement according to claim 5 wherein said guard is formed of plastics materials, and includes a pin extending through said central opening, the distal end of said pin being deformed to secure said blade and said razor one to the other.

7. An implement according to claim 1 including an opening formed through each said guard at a location thereabout at least in part clearing said blade to enable shaving debris to pass through said opening into said housing.

8. An implement according to claim 7 wherein said resilient material underlying said guards has a plurality of openings in at least partial registration, respectively, with the openings through said guards for receiving the shaving debris passed through said openings in said guards.

9. An implement according to claim 1 wherein said razor blade is circular.

10. An implement according to claim 1 including means carried by said blade defining a central opening located between a plane passing through said blade edge and said resilient material underlying said guard, said securing means extending through said central opening for securing said blade and said guard one to the other and terminating at or below said plane.

11. An implement according to claim 1 wherein said blade and said guard of at least one assemblage are circular, said guard having an annular groove in its upper surface with at least a portion thereof extending radially outwardly of said blade edge.

12. An implement according to claim 1 wherein said blade and said guard of at least one assemblage are circular, said circular guard having an interior hub underlying said circular blade, an outer margin carrying said flange spaced radially from said hub and a plurality ribs extending generally radially between said hub and said margin.

13. An implement according to claim 12 wherein said circular blade edge extends radially outwardly of said hub and is spaced radially inwardly of said margin, said plurality of ribs defining therebetween a plurality of openings for communicating shaving debris from adjacent said circular blade through said circular guard into said housing.

14. A shaving implement, comprising:

a housing including a surface with a plurality of apertures therethrough;

a razor assemblage carried by said housing for disposition in each of said apertures and including in each assemblage a guard and a blade;

each said guard having upper and lower surfaces;

means including said guard and said housing for retaining each said guard in a corresponding aperture in said housing surface;

said razor blade having a cutting edge about its periphery and facing outwardly of said blade;

means for securing said guard and said blade one to the other;

said guard having a periphery spaced outwardly of the periphery of the cutting edge of said blade and substantially equidistantly therefrom; and said razor blade being flat and lying in a single plane.

15. A shaving implement, comprising:

a housing including a surface with a plurality of apertures therethrough;

a razor assemblage carried by said housing for disposition in each of said apertures and including in each assemblage a guard and a blade;

each said guard having upper and lower surfaces;

means including said guard and said housing for retaining each said guard in a corresponding aperture in said housing surface;

said razor blade having a cutting edge about its periphery and facing outwardly of said blade;

means for securing said guard and said blade one to the other;

said guard having a periphery spaced outwardly of the periphery of the cutting edge of said blade and substantially equidistantly therefrom; and said razor blade being concave facing the side of said razor assemblage remote from said guard.

16. A shaving implement, comprising:

a housing including a surface with a plurality of apertures therethrough;

a razor assemblage carried by said housing for disposition in each of said apertures and including in each assemblage a guard and a blade;

each said guard having upper and lower surfaces;

means including said guard and said housing for retaining each said guard in a corresponding aperture in said housing surface;

said razor blade having a cutting edge about its periphery and facing outwardly of said blade;

means for securing said guard and said blade one to the other;

said guard having a periphery spaced outwardly of the periphery of the cutting edge of said blade and substantially equidistantly therefrom; and said blade having a central opening, said securing means extending through said central opening for securing said blade and said guard one to the other.

17. A shaving implement, comprising:

a housing including a surface with a plurality of apertures therethrough;

a razor assemblage carried by said housing for disposition in each of said aperture and including in each assemblage a guard and a blade;

each said guard having upper and lower surfaces;

means including said guard and said housing for retaining each said guard in a corresponding aperture in said housing surface;

said razor blade having a cutting edge about its periphery and facing outwardly of said blade;

means for securing said guard and said blade one to the other;

said guard having a periphery spaced outwardly of the periphery of the cutting edge of said blade and substantially equidistantly therefrom; and each said guard having an opening formed therethrough at a location at least in part clearing said blade to enable shaving debris to pass through said opening into said housing.

18. An implement according to claim 16 wherein said guard is formed of plastics materials, and includes a pin extending through said central opening, the distal end of said pin being deformed to secure said blade and said razor blade one to the other.

19. An implement according to claim 16 wherein said razar blade and said guard in each assemblage are circular.

* * * * *